US005450732A

United States Patent [19]

Venetucci

[11] Patent Number: 5,450,732

[45] Date of Patent: Sep. 19, 1995

[54] DISTRIBUTION SYSTEM FOR CRYOGEN

[75] Inventor: Jim M. Venetucci, Forest Park, Ill.

[73] Assignee: Liquid Carbonic Corporation, Oak Brook, Ill.

[21] Appl. No.: 235,390

[22] Filed: Apr. 29, 1994

[51] Int. Cl.[6] ..... F25D 17/02

[52] U.S. Cl. ..... 62/374; 62/63; 62/380

[58] Field of Search ..... 62/63, 374, 375, 380

[56] References Cited

U.S. PATENT DOCUMENTS

| | | | |
|---|---|---|---|
| 3,298,188 | 4/1964 | Webster et al. | 62/63 |
| 3,405,531 | 10/1968 | Davis, Jr. et al. | 62/374 |
| 3,777,988 | 12/1973 | Thompson | 62/374 |
| 4,103,507 | 8/1978 | Benois | 62/63 |
| 4,171,625 | 11/1977 | Morgan et al. | 62/380 |
| 4,336,694 | 6/1982 | Schmitt et al. | 62/374 |
| 4,441,327 | 4/1984 | Klee et al. | 62/63 |
| 4,657,768 | 4/1987 | Nagoshi | 426/524 |
| 5,020,330 | 6/1991 | Rhoades et al. | 62/63 |
| 5,205,135 | 4/1993 | Lang | 62/381 |
| 5,220,802 | 6/1993 | Kiczek et al. | 62/63 |
| 5,220,803 | 6/1993 | Kiczek | 62/63 |
| 5,256,434 | 10/1993 | Conway | 426/393 |

*Primary Examiner*—Ronald C. Capossela
*Attorney, Agent, or Firm*—Fitch, Even, Tabin & Flannery

[57] ABSTRACT

The present invention is directed to apparatus for distribution of cryogen across the width of a conveyor belt. The apparatus includes a housing for receiving cryogen from a distribution manifold mounted axially within the housing. The distribution manifold is in fluid communication with a source of cryogen. The distribution manifold has a plurality of apertures for releasing cryogen into the interior of the housing. The housing has a slot extending across the length of the housing for distribution of a curtain of cryogen onto articles to be frozen.

7 Claims, 2 Drawing Sheets

2/2
Fig. 3
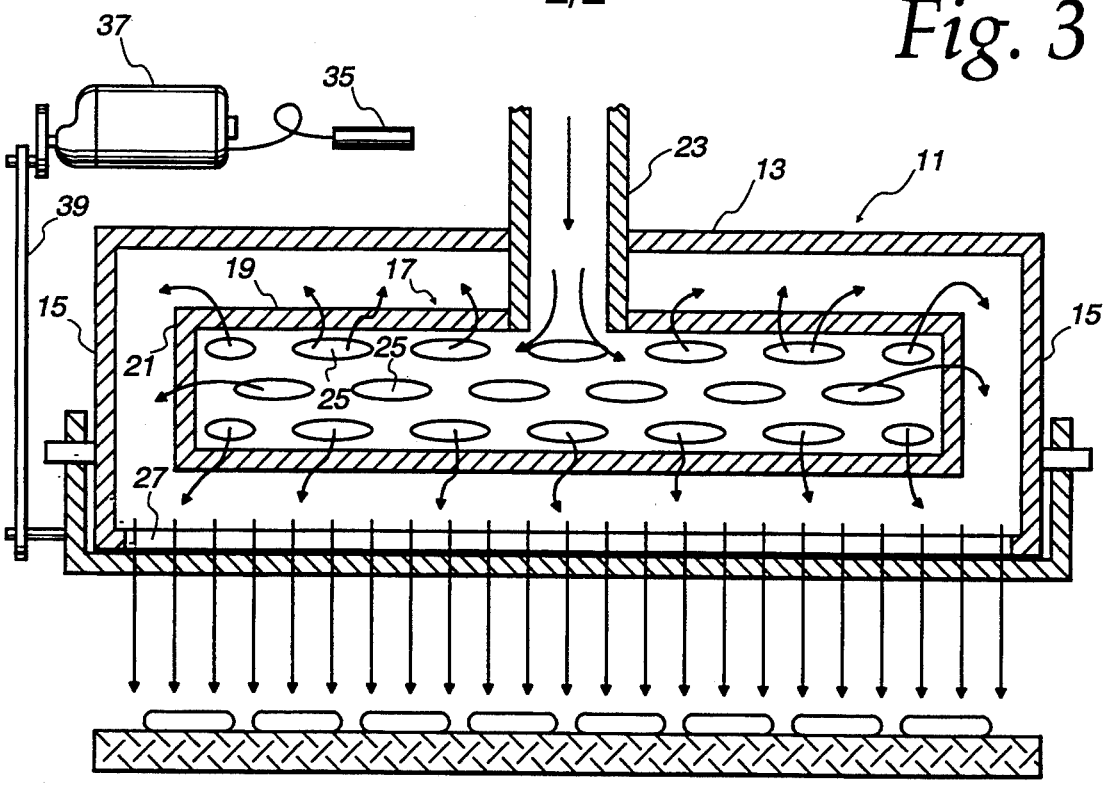
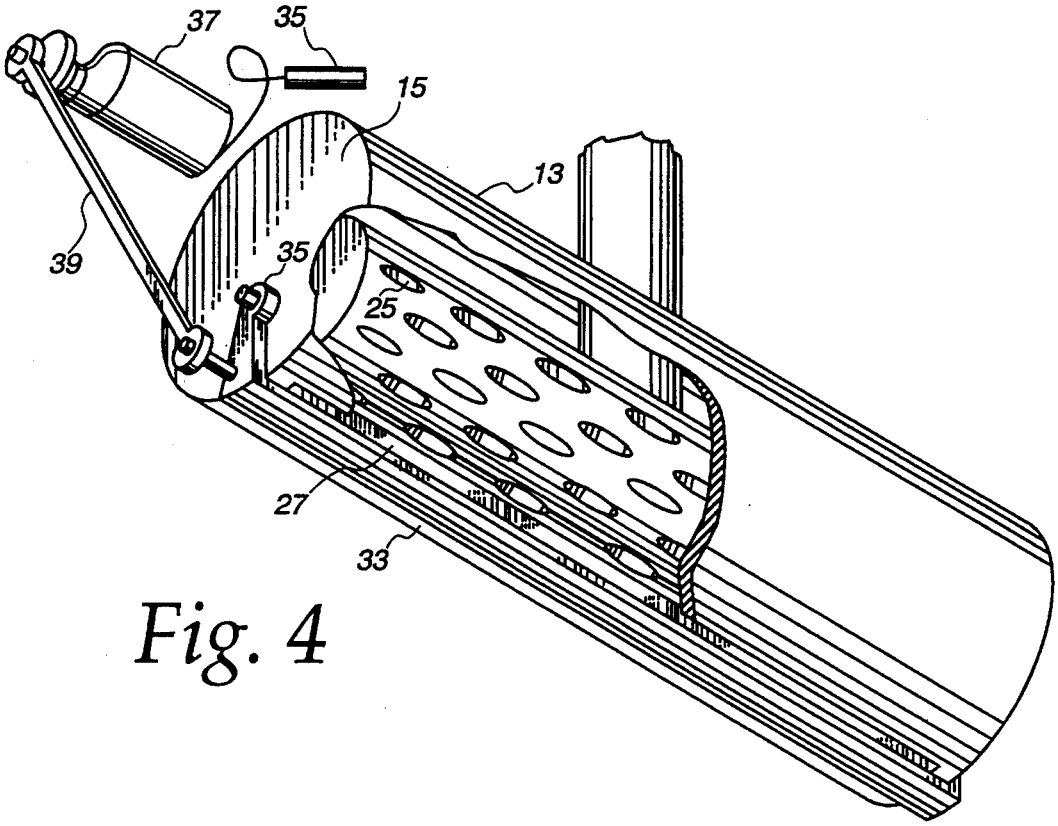
Fig. 4

DISTRIBUTION SYSTEM FOR CRYOGEN

FIELD OF THE INVENTION

The present invention is directed to a distribution system and apparatus for distribution of cryogen across the width of a conveyor belt. More particularly, the invention is directed to apparatus for distribution of cryogen which provides a curtain of cryogen across the width of a conveyor belt having articles to be frozen dispersed thereon.

BACKGROUND OF THE INVENTION

Prior art methods for applying cryogen to the surface of food products on a conveyor belt have utilized spray nozzles to spray cryogen on the food product moving on a conveyor belt in a freezer. The spray nozzles produce a cone or cylindrical shape which will only hit the product in a localized surface area on the food product. This produces uneven and undesirable freezing of the product. If the nozzles are set too low, as shown in FIG. 1, from the product, the spray misses part of the product on the conveyor belt and localized freezing occurs which could be damaging when the articles to be frozen are food products. When the spray nozzles are set too high, as set forth in FIG. 2, very little liquid reaches the product surface since the liquid changes to vapor before reaching the product surface. The present invention provides a full curtain of cryogen flow across the width of the conveyor belt. This produces an even freezing of the product across the width of the conveyor belt.

DESCRIPTION OF THE DRAWINGS

FIG. 3 is a cross-sectional view of the apparatus of the present invention for distribution of cryogen across the width of a conveyor belt; and FIG. 4 is an isometric view, partially broken away, of the apparatus of the present invention for distribution of the cryogen.

SUMMARY OF THE INVENTION

Figure 1:
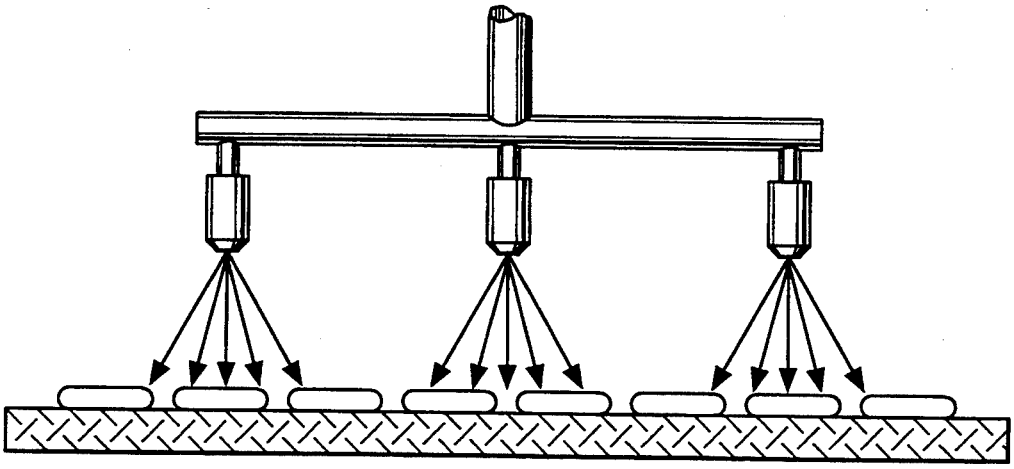
Fig. 1 PRIOR ART
FIG. 1 is a depiction of prior art nozzles set too low with respect to the product to be frozen.
Figure 2:
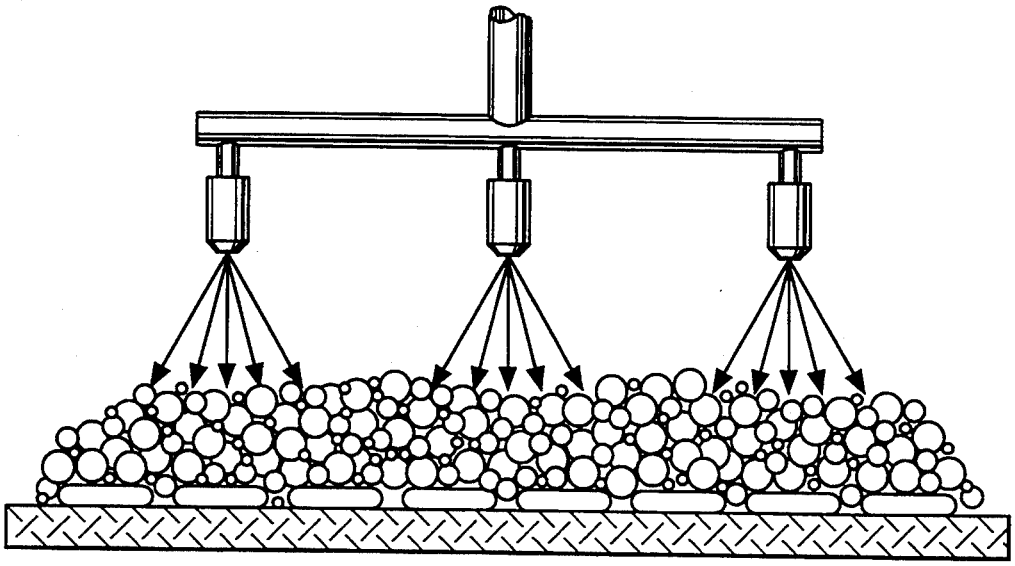
Fig. 2 PRIOR ART
FIG. 2 is a depiction of prior art nozzles set too high with respect to the product to be frozen.

The present invention is directed to apparatus for distribution of cryogen across the width of a conveyor belt. The apparatus includes a housing for receiving cryogen from a distribution manifold mounted axially within the housing. The distribution manifold is in fluid communication with a source of cryogen. The distribution manifold has a plurality of apertures for releasing cryogen into the interior of the housing. The housing has a slot extending across the length of the housing for distribution of a curtain of cryogen onto articles to be frozen.

DETAILED DESCRIPTION OF THE INVENTION

As shown in FIG. 3, the apparatus of the present invention for distribution of cryogen includes a housing 11 for receiving cryogen. The housing 11 may have any convenient cross-sectional shape, such as rectangular, but is preferably circular or ellipsoidal in cross-sectional shape. The housing 11 has sidewall 13 and endwalls 15.

A distribution manifold 17 is mounted inside housing 11. The distribution manifold 17 preferably has a cross-sectional shape which is the same as that of housing 11.

Distribution manifold 17 also has sidewalls 19 and endwalls 21. The distribution manifold 17 is in fluid communication with a source of cryogen (not shown) through pipe 23. The cryogen may be any suitable liquified gas, such as liquid nitrogen or liquid carbon dioxide. Preferably, the cryogen is liquid nitrogen. Pipe 23 also serves as a mounting point for distribution manifold 17.

Distribution manifold 17 has a plurality of apertures 25 distributed throughout the sidewall surface of distribution manifold 17. The size and shape of the apertures is not critical. A circular shape having a diameter of from about $\frac{1}{8}$ inch to about $\frac{3}{8}$ inch is preferred. Alternatively, the distribution manifold 17 can be a sintered porous metal tube. The apertures or porous metal tube permit entrained gas bubbles to separate to provide a high quality liquid cryogen from the slot 27.

A slot 27 is provided in housing 11 for distribution of a cryogen which is introduced into housing 11 through the apertures in distribution manifold 17. The slot 27 is of a length sufficient to cover the entire width of a conveyor belt for articles, such as food products to be frozen in a freezer. Cryogen introduced through pipe 23 flows through the apertures in the distribution manifold 17 to fill the chamber of the housing 11 which is spaced between the walls of housing 11 and the exterior walls of the distribution manifold 17. The cryogen within the chamber is at equal pressure over the entire slot length thereby producing an even curtain discharge of cryogen through the slot. The even discharge of the cryogen produces a full curtain across the conveyor belt and freezing occurs evenly on the food products which are dispersed across the belt.

As shown in FIG. 4, a cover 33 can be provided which extends along the entire length of slot 27. The cover 33 is mounted on housing 11 by means of pins 35. The cover 33 can be rotated about the outer sidewall surface 15 of housing 11 to vary the size of slot 27 to adjust the thickness of the cryogen curtain which is distributed by slot 27. The slot opening can be automatically controlled by means of a thermocouple 35 which activates motor 37 to move the cover 33 through linkage 39. The size of the slot is directly related to the amount of cryogen dispensed. The slot opening can be automatically controlled through a thermocouple 35 and motor 37.

What is claimed is:

1. Apparatus for distribution of cryogen across the width of a conveyor belt comprising a housing for receiving cryogen from a distribution manifold mounted axially within said housing, said distribution manifold being in fluid communication with a source of cryogen, said distribution manifold having a plurality of apertures for releasing cryogen into the interior of said housing and said housing having a slot extending across the length of said housing for distribution of a curtain of cryogen onto articles to be frozen.

2. Apparatus in accordance with claim 1 wherein said articles to be frozen are disposed on the surface of a conveyor belt passing beneath said housing.

3. Apparatus in accordance with claim 1 wherein said slot is covered along its entire length by a cover which is movable to adjust the width of said slot.

4. Apparatus in accordance with claim 3 wherein said cover is adjusted to change said slot opening by means of a thermocouple and a motor linked to said cover.

5. Apparatus in accordance with claim 1 wherein said housing and said distribution manifold is cylindrical.

6. Apparatus in accordance with claim 1 wherein said distribution manifold is a cylinder which extends partially along the axis of said housing to provide a gap between the endwalls of said distribution manifold and the endwalls of said housing.

7. Apparatus in accordance with claim 1 wherein said distribution manifold is a sintered porous metal tube.

* * * * *